US008061285B2

(12) United States Patent
Kongo et al.

(10) Patent No.: US 8,061,285 B2
(45) Date of Patent: Nov. 22, 2011

(54) SEWING MACHINE FOR STITCHING A STIPPLING PATTERN

(75) Inventors: Takeshi Kongo, Tokyo (JP); Hiromi Motoyama, Tokyo (JP); Shinichi Kato, Tokyo (JP)

(73) Assignee: Janome Sewing Machines Co., Ltd., Tokyo (JP)

( * ) Notice: Subject to any disclaimer, the term of this patent is extended or adjusted under 35 U.S.C. 154(b) by 420 days.

(21) Appl. No.: 12/455,006

(22) Filed: May 27, 2009

(65) Prior Publication Data

US 2010/0050914 A1 Mar. 4, 2010

(30) Foreign Application Priority Data

Aug. 28, 2008 (JP) ..... 2008-219046

(51) Int. Cl.
*D05B 21/00* (2006.01)

(52) U.S. Cl. ..... 112/102.5

(58) Field of Classification Search ..... 112/78, 112/80.23, 80.3, 102, 102.5, 470.01, 470.03, 112/470.04, 470.05, 470.06, 475.18, 475.19; 700/131, 136–138

See application file for complete search history.

(56) References Cited

U.S. PATENT DOCUMENTS 5,430,658 A * 7/1995 Divinsky et al. ..... 700/138
5,510,994 A * 4/1996 Tsonis et al. ..... 700/137
5,957,068 A * 9/1999 Mizuno ..... 112/102.5
5,960,726 A * 10/1999 Yamada ..... 112/102.5
6,098,559 A * 8/2000 Hirose ..... 112/475.19
6,127,022 A * 10/2000 Pretorius ..... 428/195.1
6,968,255 B1 * 11/2005 Dimaridis et al. ..... 700/131
7,814,851 B2 * 10/2010 Tashiro ..... 112/470.01

FOREIGN PATENT DOCUMENTS

JP 2008-136623 6/2008

* cited by examiner

*Primary Examiner* — Tejash Patel
(74) *Attorney, Agent, or Firm* — Nields, Lemack & Frame, LLC

(57) ABSTRACT

The convex portions 25 are formed as arranged in contact or substantially in contact with the points A1~A7 of first group respectively that are provided on the upper side limit line 76 and the concave portions 26 are formed as arranged with a predetermined space provided away from the points a1~a7 of first group respectively that are provided on the lower side limit line 77. On the other hand, the concave portions 26 are formed as arranged with a predetermined space provided away from the points of second group respectively that are provided on the upper side limit line 76 and the convex portions 25 are formed as arranged in contact or substantially in contact with the points b1~b4 of second group respectively that are provided on the lower side limit line 77. Thus the upper and lower side limit lines 76, 77 that are arranged opposite to each other have the points A and a of first group and the points B and b of second group provided thereon respectively while the convex portions 25 and the concave portions 26 are formed as arranged in reversed relation in connection with the upper and lower side limit lines 76 and 77.

9 Claims, 9 Drawing Sheets

SEWING MACHINE FOR STITCHING A STIPPLING PATTERN

BACKGROUND OF THE INVENTION

1. Field of the Invention

The present invention relates to a sewing machine for stitching a stippling pattern.

2. Related Art

The stippling pattern is such a pattern as depicted by a continuous line that is variously and complicatedly curved and is generally used for kilting stitches and the like.

The stippling pattern is generally stitched by manual operation by use of so called a free motion technique. Namely the stitching operation speed of sewing machine is adjusted by manipulation of a machine motor controller with manual adjustment of transporting amount of cloth while the feed dog is made ineffective as is moved to a lower position. However a special skill is required to stitch a proper stippling pattern because it is required that the cloth transporting amount and the stitching operation speed of sewing machine needle are simultaneously adjusted so that the pitch width of stitches may be maintained constant. It is, therefore, almost impossible for the machine users in general to stitch the stippling pattern at a large kilt cloth by use of a sewing machine.

Under such circumstances, it has been recently proposed to mechanically stitch the stippling pattern as shown in the document JP-A-20(2008)-136623 by way of example. The document discloses a technique to automatically produce the stippling pattern data.

SUMMARY OF THE INVENTION

In case the stippling pattern is stitched mechanically by use of a sewing machine, it is impossible to stitch the stippling pattern at a time in a large stitching area. In this case, it is required to stitch the stippling pattern in a plurality of steps while the cloth is displaced relative to the holder that holds the cloth to be stitched.

In such case that the stippling pattern is to be stitched in a plurality of steps, it may be considered that a large pattern is stitched while it is divided and that a unit pattern is repeatedly stitched. In the former case, it is very difficult to restore the pattern with the divided parts which may be often displaced from the original position.

In the latter case, the unit patterns are often overlapped or inappropriately spaced from one another showing gaps between the unit patterns. In any events, it is very difficult to stitch a large pattern with a view of integration as a whole.

It is a principal object of the invention to solve such problems of prior art.

The stippling pattern of the invention may be stitched by use of a sewing machine that may be used to stitch embroidery patterns. According to the invention, the stippling pattern is stitched in a square embroidery stitching area, and the stitch data for stitching the stippling pattern is provided to form convex portions as are depicted substantially in contact with a plurality of points of first group respectively, the points of first group being provided on one of the opposite sides of the square embroidery stitching area, and further to form concave portions as are depicted with a predetermined space away from a plurality of points of second group respectively, the points of second group being provided on said one of the opposite sides of the square embroidery stitching area, the stitch data further forming concave portions as are depicted with a predetermined space provided away from a plurality of points of first group respectively, the points of first group being provided on the other of the opposite sides of the square embroidery stitching area, and forming convex portions as are depicted as arranged substantially in contact with a plurality of points of second group respectively, the points of second group being provided on said other of the opposite sides of the square embroidery stitching area.

Therefore in case the stippling pattern of such type is stitched in combination with a plurality of unit stippling patterns with one of the opposite sides of the square embroidering area being arranged in contact with the other of the opposite sides of the square embroidering area, so large a stippling pattern may be obtained, an integrated pattern that is free of discrepancy or overlap between the unit patterns.

According to the invention, a large sized and integrated stippling pattern may be stitched by combination of a plurality of unit stippling patterns, the pattern that is free of discrepancy or overlap at the junctions between the unit patterns.

Figure 1:
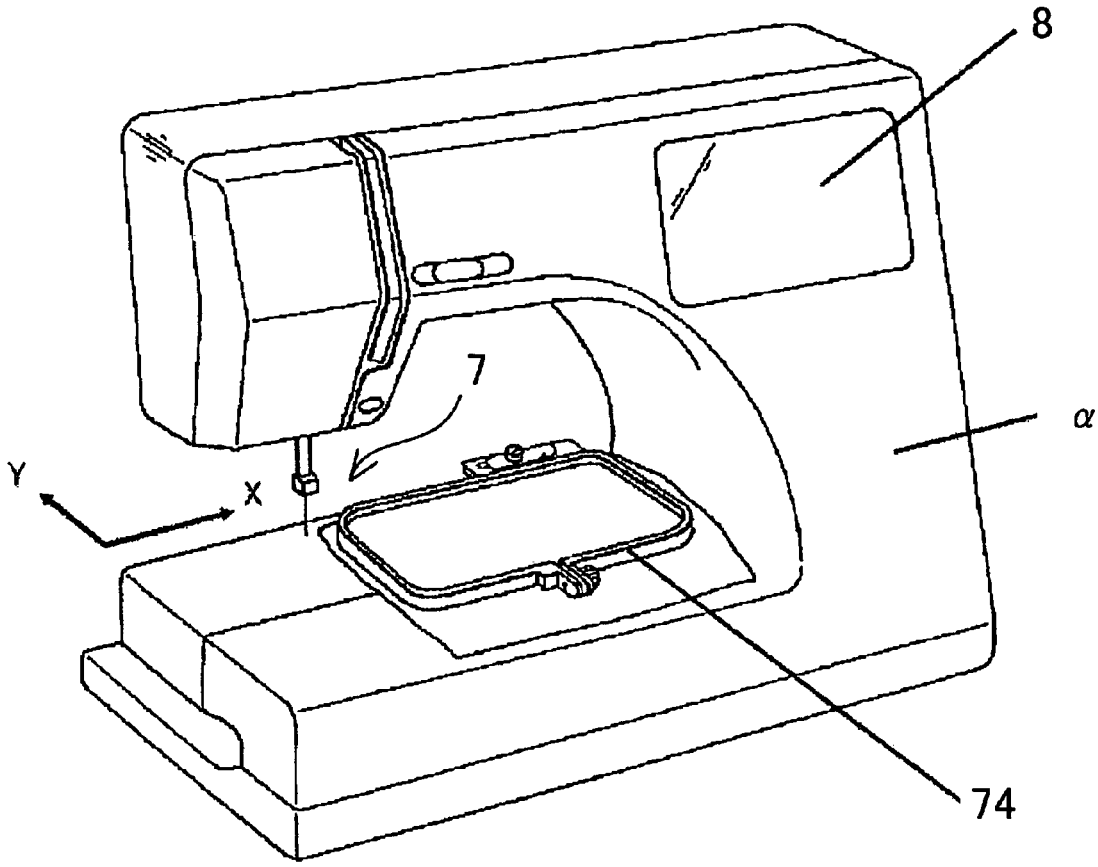
FIG. 1 is a perspective view of one embodiment of the invention.

1: Pattern selecting device
2: Pattern memory
3: Cloth size input device
4: Pattern number calculating device
5: Magnification calculating device
6: Stitch modifying device
7: Stitching mechanism
8: Display
9: Printer
10: Selection input device
20: Stippling pattern
21: Pattern depicting line
25: Convex portion
26: Concave portion
30: Cloth
50: Enlarging/reducing rate deciding device
70: Machine motor control device
71: Machine motor
72: X/Y motor control device
73: X/Y motors
74: Embroidering frame
75: Embroidery stitching area
76: Upper limit line
77: Lower limit line
78: Left side limit line
79: Right side limit line
80: Display control device
90: Printer driving device
100: Central processor unit

DETAILED DESCRIPTION OF THE PREFERRED EMBODIMENTS

The invention will be described in reference to the embodiment as shown in the attached drawings.

FIG. 1 shows the embodiment of the invention that is a sewing machine having a stippling pattern stitching apparatus provided therein.

The sewing machine α is provided with a stitching mechanism 7 and a display 8, and is further provided with an embroidering frame 74. The embroidering frame 74 is provided to have a cloth set thereto, the cloth being the object where a stippling pattern is embroidered. The cloth may be reset to the embroidering frame 74 so as to displace the cloth relative to the embroidering frame 74 for the purpose of stitching a stippling pattern at the cloth, the stippling pattern being of a size exceeding the size of the embroidering frame 74.

Figure 2:
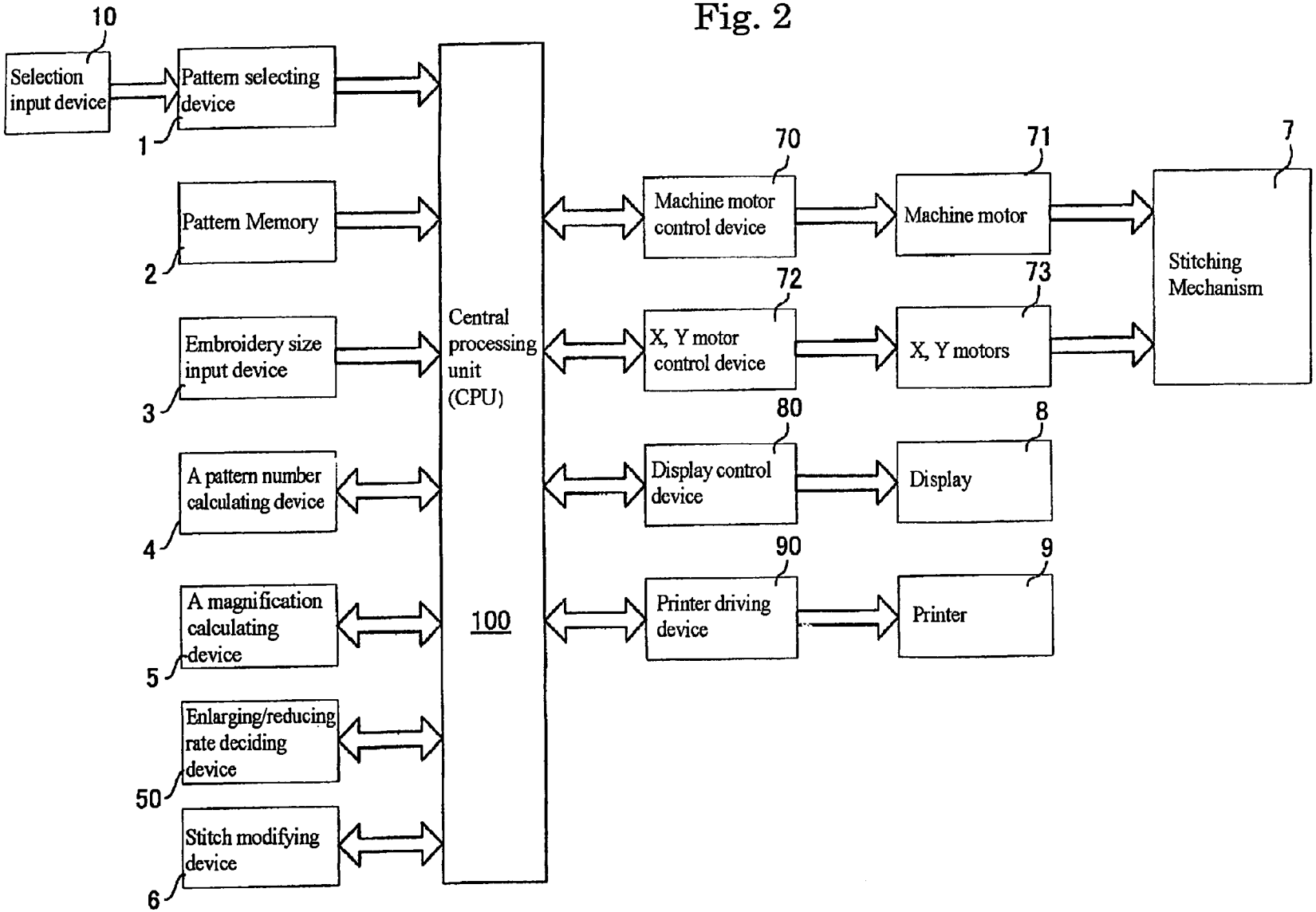
FIG. 2 is a block diagram showing the functions of the embodiment of invention.

The embodiment will be further described in detail in reference to the block diagram as shown in FIG. 2.

The sewing machine a is so formed as to be operated under control of a central processing unit (CPU) 100. The central processing unit (CPU) 100 gives instructions to the machine motor control device 70 for controlling the rotation of the machine motor 71 that controls the operation of the stitching mechanism 7 including a machine needle and a feed dog. Further the CPU 100 controls the operation of the X/Y motor control device 72 for controlling the X/Y motors 73 which are operated to move the embroidering frame 74 in x and y directions relative to the machine needle, thereby to stitch the stippling pattern. The machine motor control device 70, X/Y motor control device 72, machine motor 71, X/Y motors 73, stitching mechanism 7, embroidering frame 74 substantially compose an apparatus for stitching the stippling pattern.

Further the display 8 is provided to give the information about stitching operation that is transmitted thereto through the display control device 80.

A pattern memory 2 is connected to the CPU 100. The pattern memory 2 is provided to store therein stitch data and the corresponding display data for at least one unit stippling pattern. The stitch data is normally a collection of x and y coordinates for deciding the needle dropping positions.

Figure 3:
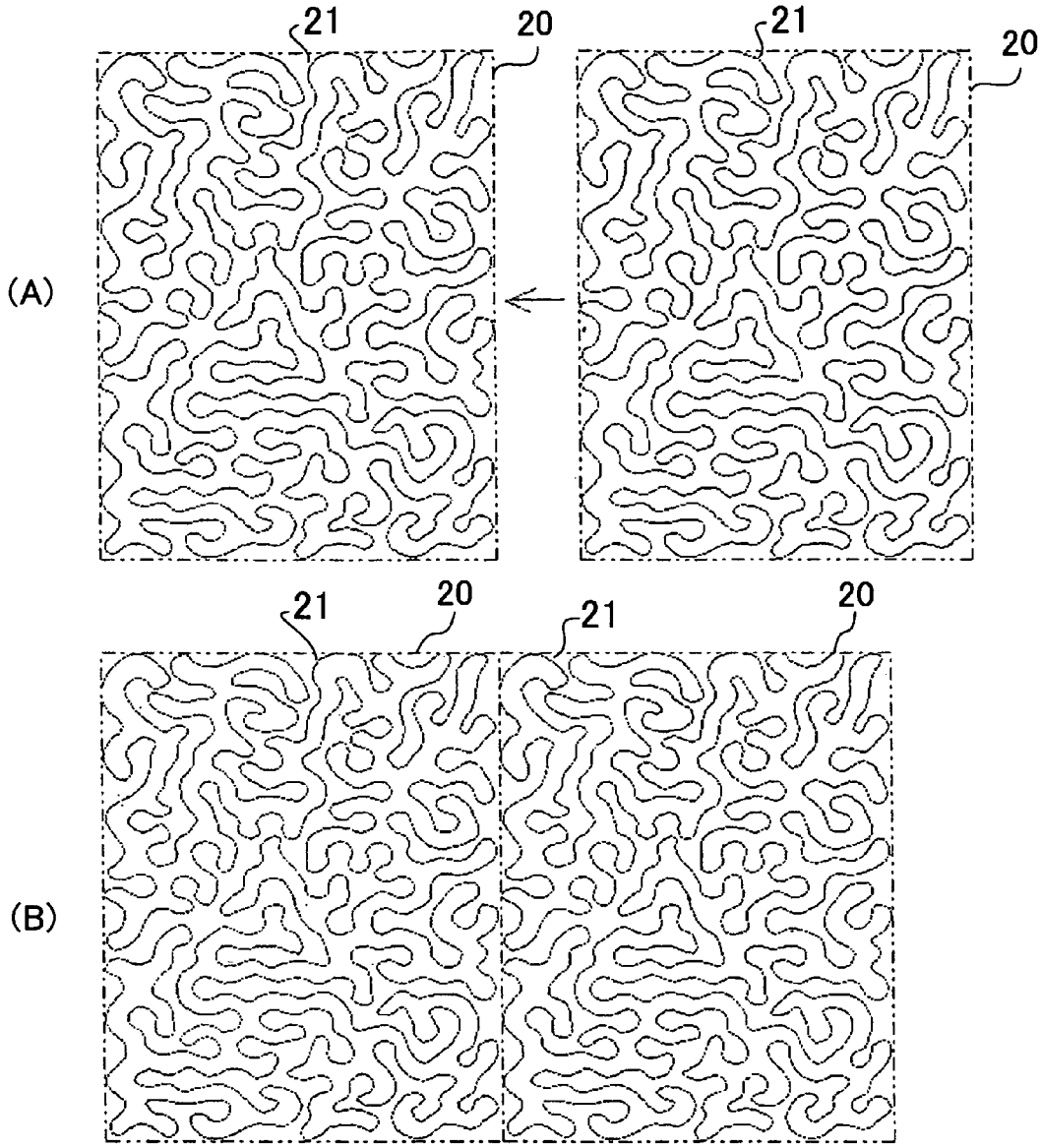
FIG. 3 is an explanatory view of the embodiment of the invention.

FIG. 3 shows a stippling pattern 20 by way of example which may be stitched by use of the stitch data stored in the pattern memory 2. As shown, a plurality of complicated patterns are formed by a single continuous pattern line 21.

The method as mentioned hereinbefore for stitching the stippling pattern by repeatedly stitching a unit pattern is, at first, to set a kilt cloth to the embroidering frame as it is tensed thereon and is then to arrange a plurality of selected unit stippling patterns 20 in combination in alignment vertically and laterally, and is then to stitch the arranged patterns 20 one by one. In this case, as shown in FIG. 3, it is designed that the concave and convex portions that are depicted adjacent to the circumferential boundaries of one unit stippling pattern 20 are stitched as arranged substantially opposite to the convex and concave portions of the other unit stippling pattern 20 at the junction between the two unit stippling patterns 20, so that the finished embroidery pattern may be so large and united into one pattern.

Figure 4:
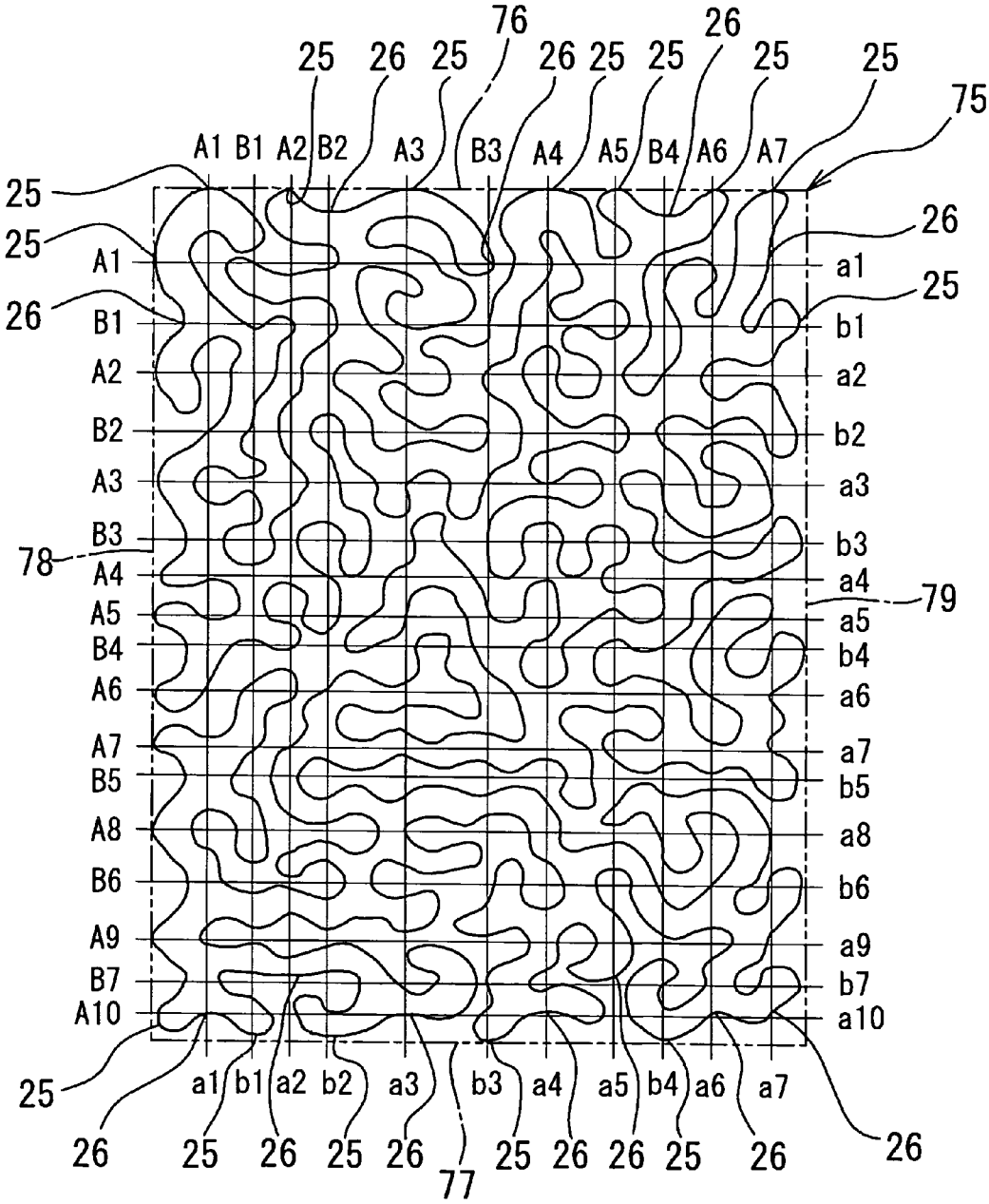
FIG. 4 is an explanatory view of the embodiment of the invention.

The formation of unit stippling pattern 20 will be described further in detail in reference to FIG. 4. The stippling pattern is stitched within an embroidery stitching area 75 that is square and is smaller than the area that is defined by the embroidering frame 74.

The embroidery stitching area 75 is defined by upper and lower side limit lines 76, 77 which are opposite to each other and is further defined by left and right side limit lines 78, 79 which are opposite to each other.

The upper side limit line 76 has a first group of points, that is, a plurality of points A1~A7 provided thereon and the lower side limit line 77 has a plurality of points a1~a7 provided thereon which are also a first group of points corresponding to the points A1~A7 respectively. The points A1~A7 and the points a1~a7 are given so as to provide so many lines passing through the points A1~A7 and the corresponding points a1~a7 respectively and extending in parallel with the left side limit line 78.

As shown, the convex portions 25 of the stippling pattern are formed in contact or substantially in contact with the points A1~A7 of first group respectively. Precisely the convex portions 25 are formed by a continued pattern depicting line 21 as so many portions of the stippling pattern 20.

On the other hand, the concave portions 26 of the stippling pattern are formed with a predetermined space provided away from the points a1~a7 respectively of the lower side limit line 77. The concave portions 26 are formed by a continued pattern depicting line 21 as so many portions of the stippling pattern 20. As shown the concave portions 26 are formed with a line extending as curved away from the points a1~a7 respectively.

Further the upper side limit line 76 has a second group of points, that is, a plurality of points B1~B4 provided thereon and the lower side limit line 77 has a plurality of points b1~b4 provided thereon which are also a second group of points corresponding to the points B1~B4 respectively. The points B1~B4 and the points b1~b4 are given so as to provide so many lines passing through the points B1~B4 and the corresponding points b1~b4 respectively and extending in parallel with the left side limit line 78.

The concave portions 26 of the stippling pattern are formed with a predetermined space provided away from the points B1~B4 respectively of the upper limit line 76. The concave portions 26 are formed by a continued pattern depicting line 21 as so many portions of the stippling pattern 20. As shown the concave portions 26 are formed with a line extending as curved away from the points B1~B4 respectively.

On the other hand, the convex portions 25 of the stippling pattern are formed in contact or substantially in contact with the points b1~b4 respectively of the lower side limit line 77. The convex portions 25 are formed by a continued pattern depicting line 21 as so many portions of the stippling pattern 20.

As described hereinbefore, the upper and lower side limit lines 76 and 77 extended opposite to each other have a first group of points A and a and a second group of points B and b provided thereon respectively, the points A and points a being opposite to one another in correspondence and the points B and points b being opposite to one another in correspondence. Further the convex and concave portions 25 and 26 of stippling pattern are so formed as to correspond to the points A and points a and the points B and points b respectively. More precisely the convex portions 25 are formed in connection with the points A of the first group and in connection with the points b of the second group while the concave portions 26 are formed in connection with the points a of the first group and in connection with the points B of the second group.

Namely the pattern depicting line extends as curved toward and away from the points provided on the upper and lower limit lines 76, 77.

Just in the same manner, the left and right side limit lines 78 and 79 have respectively a first group of a plurality of points A and the corresponding points a provided thereon and have a second group of a plurality of points B and the corresponding points b provided thereon. And similarly the same convex and concave portions 25 and 26 are formed in connection with the points A and a and the points B and b.

Figure 5:
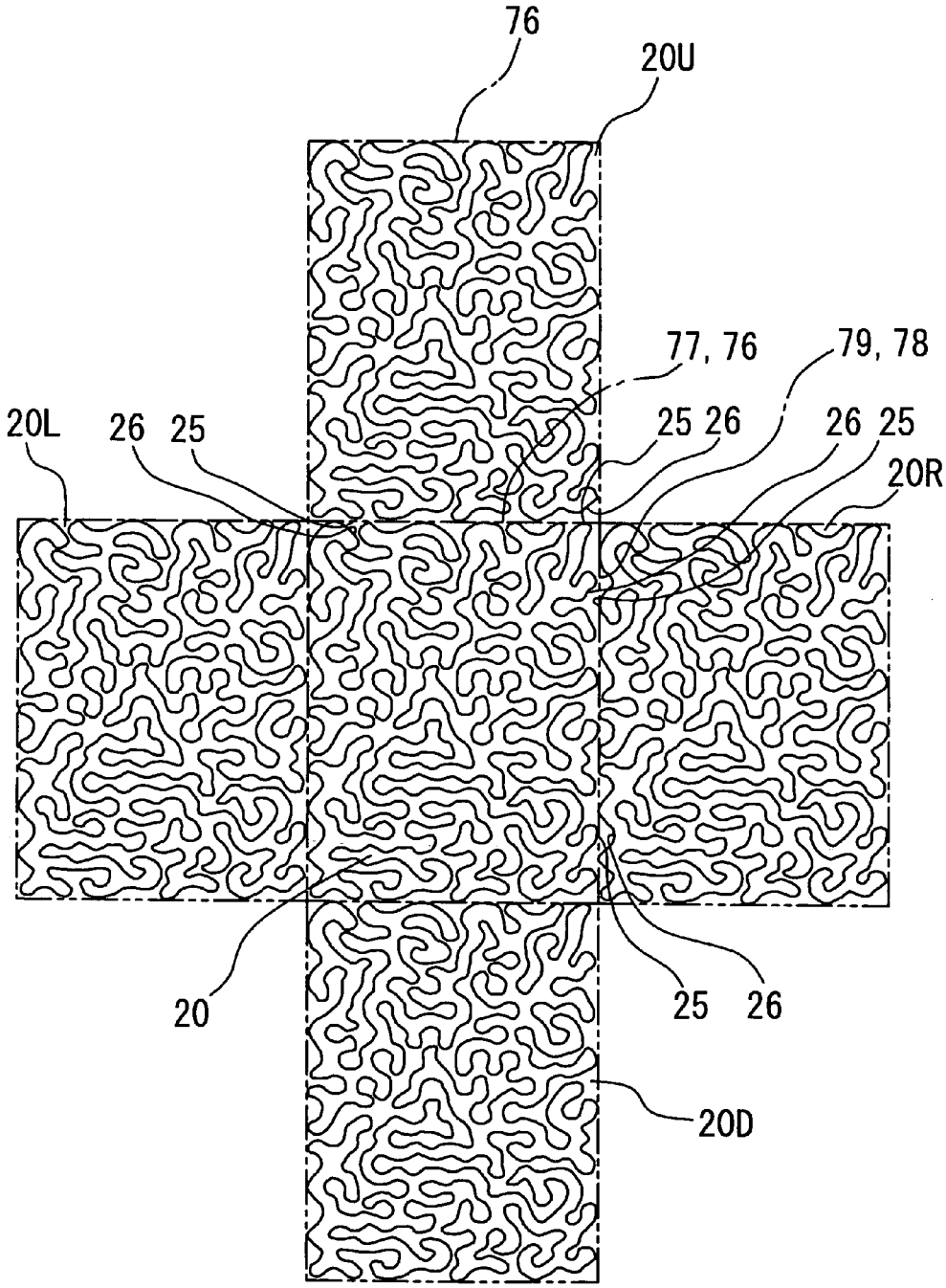
FIG. 5 is an explanatory view of the embodiment of the invention.

FIG. 5 shows a plurality of stippling patterns 20 of the formation as described hereinbefore, the stippling patterns 20 being connected with one another as arranged in alignment vertically and laterally by way of example. Particularly as to the junction between the stippling pattern 20U and the stippling pattern 20 where the lower side limit line 77 of the stippling pattern 20U and the upper limit line 76 of the stippling pattern 20 are in contact with each other, the convex and concave portions 25 and 26 of the stippling pattern 20U and the convex and concave portions 25 and 26 of the stippling pattern 20 are arranged opposite to one another in reversed relation. Precisely the convex portions 25 of the stippling pattern 20U are arranged opposite to the concave portions 26 of the stippling pattern 20 respectively while the concave portions 26 of the stippling pattern 20U are arranged opposite to the convex portions 25 of the stippling pattern 20 respectively.

Under the circumstances, in case the stippling pattern 20 is stitched successively, the pattern 20 will not overlap or will not be unnaturally spaced from the other at the junction. Instead, a beautiful and integrated pattern may be stitched as shown in FIG. 5.

As described hereinbefore, the left and right side limit lines 78 and 79 have respectively a first group of a plurality of points A and the corresponding points a provided thereon and have a second group of a plurality of points B and the corresponding points b provided thereon. Namely the left side upper limit line 78 is provided with a first group of points, that is, a plurality of points A1~A10 and the right side limit line 79 is provided with a plurality of points a1~a10 which are also a first group of points corresponding to the points A1~A7 respectively. The points A1~A10 and the points a1~a10 are given so as to provide so many lines passing through the points A1~A10 and the corresponding points a1~a10 respectively and extending in parallel with the upper limit line 76.

As shown, the convex portions 25 of the stippling pattern are formed in contact or substantially in contact with the points A1~A10 of first group respectively. Precisely the convex portions 25 are formed by a continued pattern depicting line 21 as so many portions of the stippling pattern 20.

On the other hand, the concave portions 26 of the stippling pattern are formed with a predetermined space provided away from the points a1~a10 respectively of the right side limit line 79. The concave portions 26 are formed by a continued pattern depicting line 21 as so many portions of the stippling pattern 20. As shown the concave portions 26 are formed with a line extending as curved away from the points a1~a10 respectively.

Further the left side limit line 78 is provided with a second group of points, that is, a plurality of points B1~B7 and the right side limit line 79 is provided with a plurality of points b1~b7 which are also a second group of points corresponding to the points B1~B7 respectively. The points B1~B7 and the points b1~b7 are given so as to provide so many lines passing through the points B1~B7 and the corresponding points b1~b7 respectively and extending in parallel with the upper limit line 76.

The concave portions 26 of the stippling pattern are formed with a predetermined space provided away from the points B1~B7 respectively of the left side limit line 78. The concave portions 26 are formed by a continued pattern depicting line 21 as so many portions of the stippling pattern 20. As shown the concave portions 26 are formed with a line extending as curved away from the points B1~B7 respectively.

On the other hand, the convex portions 25 of the stippling pattern are formed in contact or substantially in contact with the points b1~b7 of first group respectively of the right side limit line 79. Precisely the convex portions 25 are formed by a continued pattern depicting line 21 as so many portions of the stippling pattern 20.

Particularly as to the junction between the stippling pattern 20 and the stippling pattern 20R as shown in FIG. 5 where the right side limit line 79 of the stippling pattern 20 and the left side limit line 78 of the stippling pattern 20R are connected to each other, the convex and concave portions 25 and 26 of the stippling pattern 20 and the convex and concave portions 25 and 26 of the stippling pattern 20R are arranged opposite to one another in reversed relation. Precisely the convex portions 25 of the stippling pattern 20 are arranged opposite to the concave portions 26 of the stippling pattern 20R respectively while the concave portions 26 of the stippling pattern 20 are arranged opposite to the convex portions 25 of the stippling pattern 20R respectively.

Under the circumstances, in case the stippling pattern 20 of the formation as described hereinbefore is stitched successively in vertical or lateral direction, the pattern 20 will not overlap or will not be unnaturally spaced from the other at the junction. Instead, a beautiful and integrated pattern may be stitched as shown in FIG. 5.

Subsequently a method for arranging the stippling pattern of the formation as described hereinbefore will be described by way of example.

Figure 6:
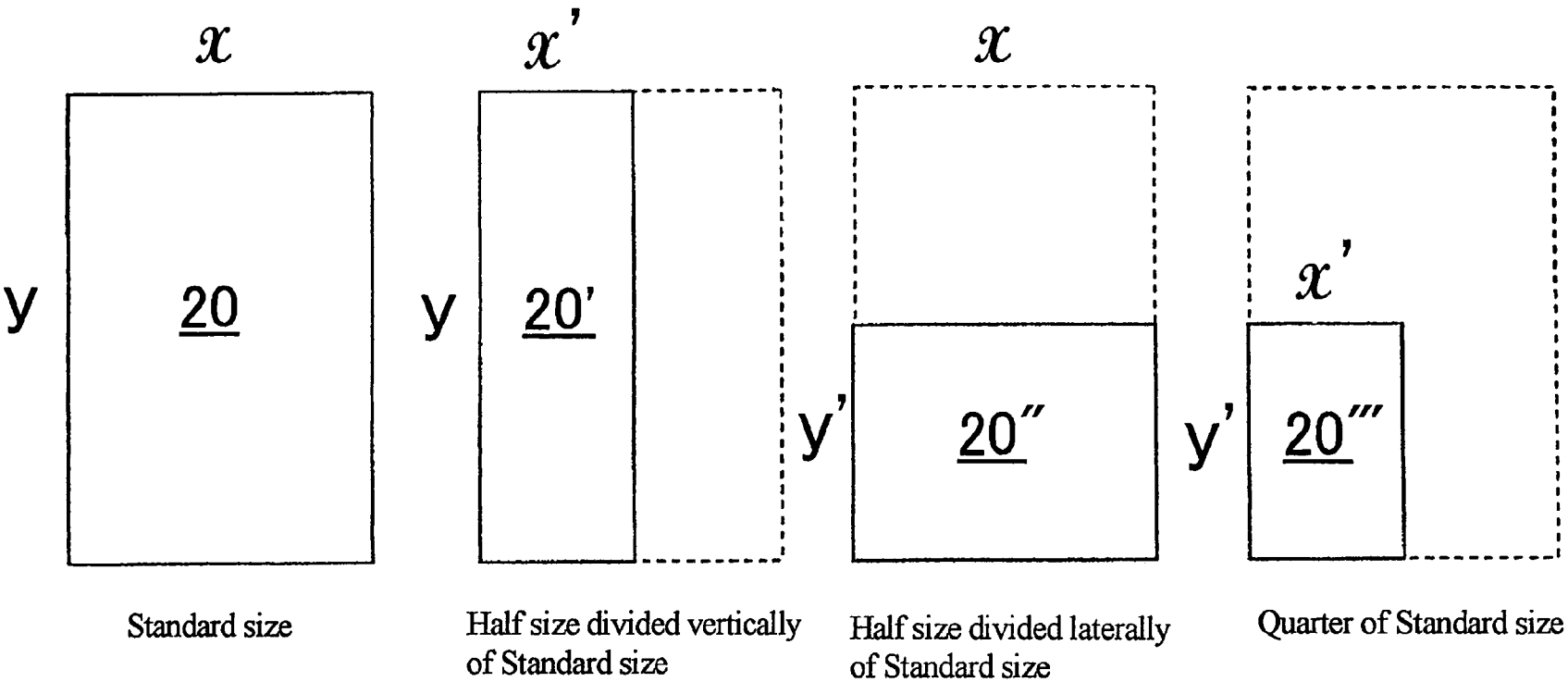
FIG. 6 is an explanatory view of the embodiment of the invention showing a stippling pattern 20 of different sizes by way of example.

According to the embodiment, as shown in FIG. 6, the pattern memory 2 stores therein the pattern data for a stippling pattern 20 of standard size that is of lateral and vertical measures x and y, for a stippling pattern 20' of a size that is a half vertically of the standard sized stippling pattern 20, that is of measures x'=1/2x and y, for a stippling pattern 20" of a size that is a half laterally of the standard sized stippling pattern 20, that is of measures x and y'=1/2y, and for a stippling pattern 20'" of a size that is a quarter (¼) of the standard sized stippling pattern 20, that is of measures x'=1/2x and y'=1/2y.

The standard sized stippling pattern 20 has the vertical and lateral lengths corresponding to the embroidery stitching area 75 that is defined by the vertical and lateral lengths of the embroidering frame 74.

Incidentally the pattern data for different stippling patterns may be additionally stored in the pattern memory 2.

A pattern selecting device 1 is provided to select and read out the stippling pattern 20 from the pattern memory 2. The pattern selecting device 1 includes a pattern input device 10 which is operated by a machine user to designate the stippling pattern 20. The CPU 100 may give instruction to select and read out the stippling pattern 20 from the pattern memory 2. The data for the stippling pattern 20 thus selected and read out is stored in a temporary memory (not shown) provided in the CPU 100.

A cloth size input device 3 is provided so as to be operated by a machine user to input the size of an object including a cloth where an embroidery pattern is stitched. Actually the vertical and lateral measures of the cloth where an embroidery pattern is stitched is inputted. Generally a considerably large cloth is employed to stitch the stippling pattern thereat. The cloth is generally larger than the size of the stippling pattern 20.

According to the embodiment of the invention, a plurality of stippling patterns 20 which are to be embroidered in combination are arranged in alignment vertically and laterally in a predetermined size XY of a kilt cloth while the size of unit stippling pattern 20 is adjusted.

A pattern number calculating device 4 is provided to calculate out the number that is the integer of unit patterns arranged vertically and laterally that corresponds to the size of the object where a pattern is embroidered, the calculation being made on the basis of the size of the object and the predetermined vertical and lateral lengths of selected unit pattern. Namely the pattern number calculating device 4 will calculate out the number of stippling pattern 20 that is to be arranged in alignment vertically and the number of stippling pattern 20 that is to be arranged in alignment laterally that correspond to the size of cloth, the calculation being made on the basis of the vertical and lateral lengths of the pattern selected at the pattern selecting device 1 and the vertical and lateral lengths of the cloth designated at the cloth size input device 3.

Figure 7:
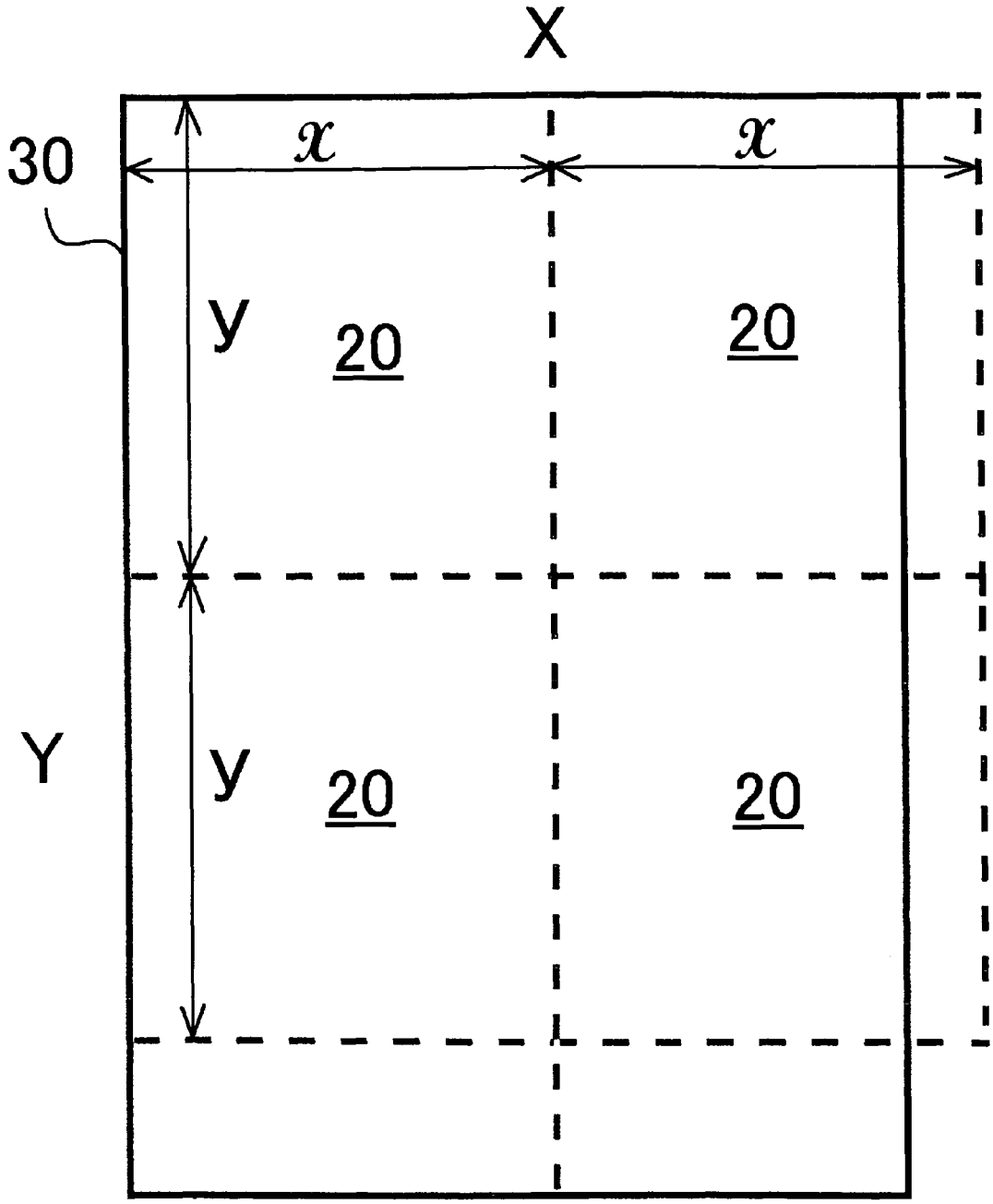
FIG. 7 is an explanatory view of the embodiment of the invention shown as is operated in one way.
Figure 8:
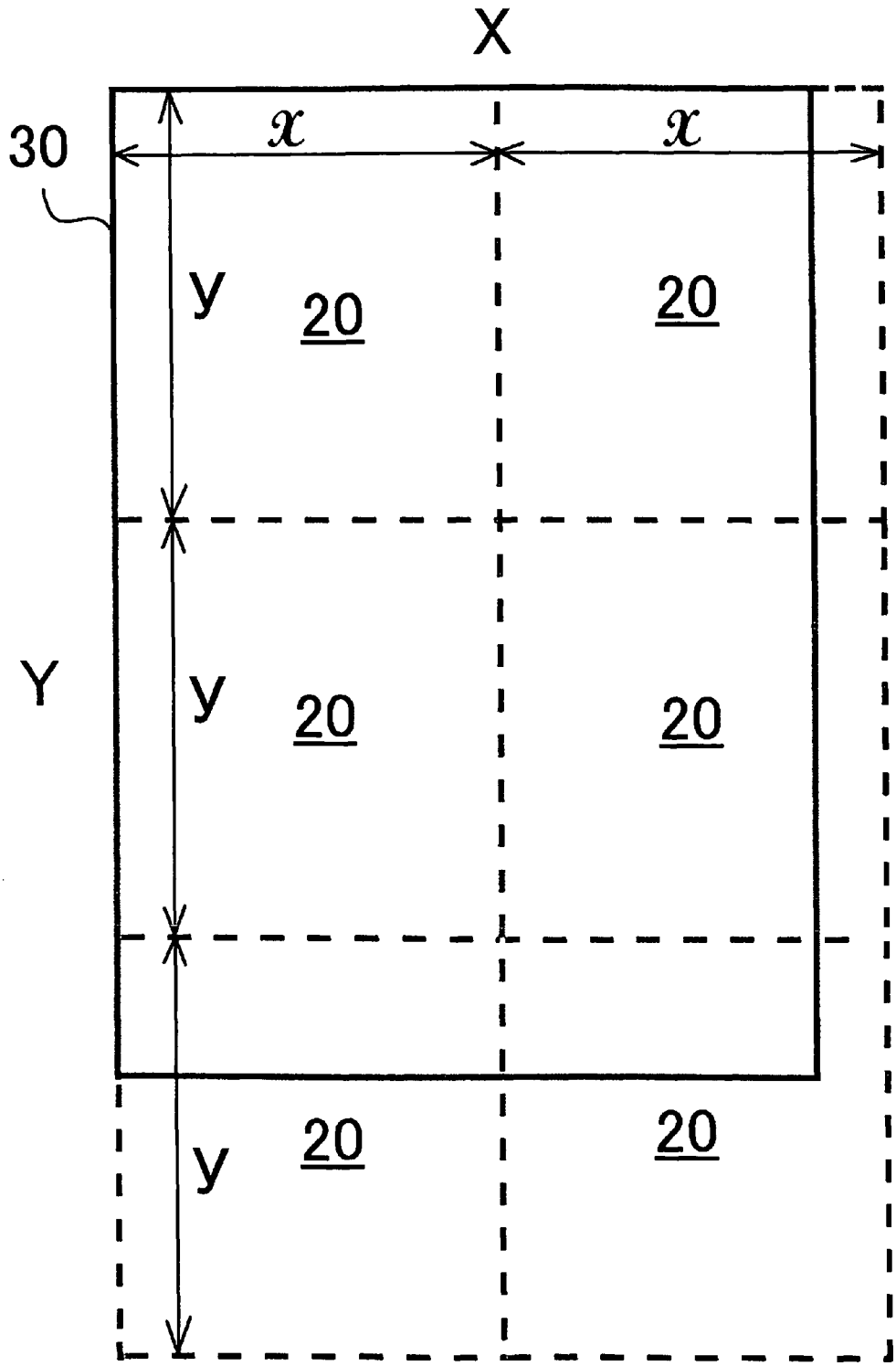
FIG. 8 is an explanatory view of the embodiment of the invention shown as is operated in another way.

The embodiment of the invention will be further described in detail in reference to FIGS. 7 and 8.

As shown in FIG. 7, in case the pattern 20 of lateral size x and vertical size y is embroidered in the cloth 30 of lateral size X and vertical size Y, two stippling patterns 20 may be arranged in alignment laterally and two stippling patterns 20 may be arranged in alignment vertically as shown. On the other hand, as shown in FIG. 8, two stippling patterns 20 may be arranged in alignment laterally and three stippling patterns 20 may be arranged in alignment vertically as shown.

Normally the number that is the integer of patterns may be obtained by calculation $X \div x$ and $Y \div y$ and by rounding off. Further the integer may be sought by rounding down and rounding up so as to select the arrangement by small rate of enlargement and reduction as will be described hereinlater.

As shown in FIGS. 7 and 8, the arrangement of stippling patterns 20 that is indicated by calculation made at the pattern number calculating device 4 is generally not completely adapted to the size of cloth 30. In this connection, a stitch modifying device 6 is provided. The stitch modifying device 6 is so formed as to enlarge and reduce the stippling pattern data in lateral and vertical directions independently in order that x×number of stippling pattern 20 arranged laterally and y×number of stippling pattern 20 arranged vertically may be in accord with the size XY of cloth 30 in compliance with the arrangement of stippling patterns calculated out at the pattern number calculating device 4. Namely the stitch data of stippling pattern 20 is multiplied by enlarging and reducing rates $\alpha,\beta$ respectively so as to enlarge and reduce the stippling patterns 20 in lateral and vertical directions. As the result, the lateral and vertical sizes of stippling pattern 20 will become $x\times\alpha$, $y\times\beta$. The stippling patterns 20 thus enlarged and reduced are adapted to the size XY of cloth 30, that is, $X=x\times$ number of stippling pattern 20 arranged laterally and $Y=y\times$ number of stippling pattern 20 arranged vertically.

In this connection, the stitch modifying device 6 is provided to calculate out the enlarging and reducing rates of the vertical and lateral sizes of unit pattern so that the unit pattern may be adapted to the object where the pattern is embroidered, the calculation being made on the basis of the number of patterns arranged in alignment vertically and laterally and the size of the object where the pattern is embroidered.

As to the enlargement and reduction of embroidery patterns in general, a same magnification rate is normally adopted vertically and laterally of the pattern so as to avoid the deformation of pattern. However according to the invention, the size of unit pattern 20 is adjusted independently as to the vertical and lateral measures thereof without giving a sense of deformity because the stippling pattern 20 is originally something particular that will give no sense of deformity in spite of some modification. Further as the integral number of stippling patterns 20 are arranged, no discrepancy will be caused between the stippling patterns.

Further as is described hereinbefore, the unit stippling patterns 20 are arranged with junctions appropriately shared by the adjacent patterns 20, an integrated combination of unit patterns may be obtained.

The sewing machine $\alpha$ is provided with a printer 9 that may be operated to print the pattern to be stitched at the cloth 30. Namely the printer 9 may be operated to print out a whole of the stippling patterns 20 as are arranged in alignment vertically and laterally and enlarged and reduced in accordance with the size of cloth 30, so that the printed pattern may be used for positional adjustment between the cloth 30 and the embroidering frame 74.

Further the printer 9 may receive the information as outputted thereto, the information including the number of patterns arranged in alignment vertically and laterally, the magnification rate of patterns, stitching information, drafting information and the template of unit stippling pattern.

The CPU 100 is further connected to an enlarging/reducing rate deciding device 50 which decides if the enlarging/reducing rates calculated out at the magnification rate calculating device 5 exceed predetermined values. In case the calculated enlarging/reducing rates exceed the predetermined values, the CPU 100 gives an instruction to the display 8 to indicate the fact. The predetermined values may be set as the limit magnification rates that will not cause deformation of the pattern.

Further the CPU 100 is so formed as to cause the pattern selecting device 1 to select the stippling patterns 20 of different sizes from the pattern memory 2 in case the enlarging/reducing rate deciding device 50 decides that the calculated enlarging/reducing rates exceed the predetermined values as to the standard sized pattern. Namely as shown in FIG. 8, the pattern of another size may be optionally selected among the patterns of vertical half size, of lateral half size and of quarter size. In this case, the pattern number calculating device 4 and the magnification rate calculating device 5 are operated accordingly. Even in case that the enlarging/reducing rates are decided as exceeding the predetermined values as to the newly selected pattern. In this case, it is required to repeat the same pattern size selecting operation.

Figure 9:
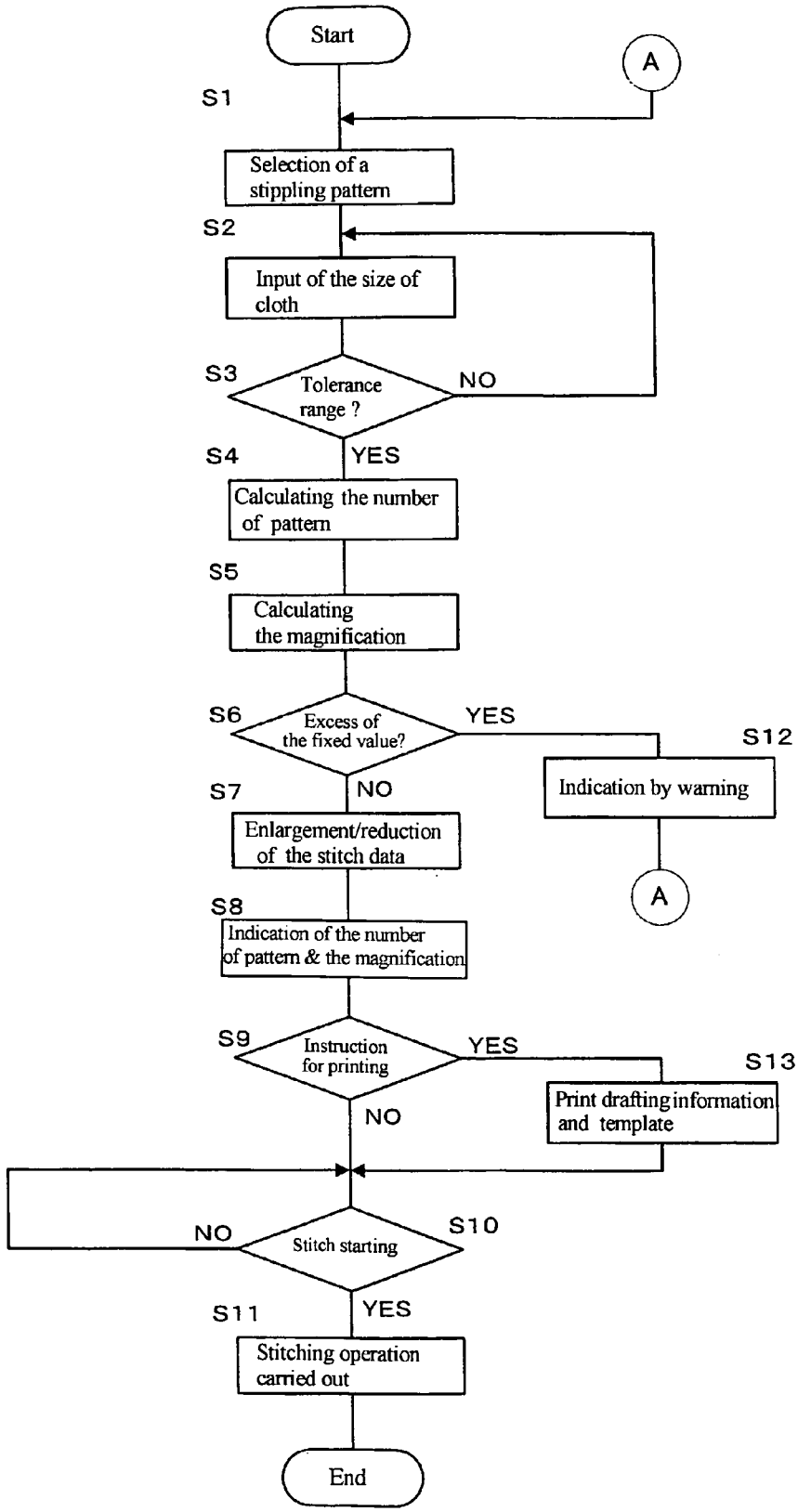
FIG. 9 is a flowchart showing the operations of the embodiment of the invention.

Subsequently the operation of the invention will be described in reference to the flowchart as shown in FIG. 9.

A stippling pattern 20 is optionally selected among those read out from the pattern memory 2 and indicated at the display 8 (step S1). The vertical and lateral lengths XY of cloth 30 where the pattern is stitched are designated (steps S2, S3). The number (integer) of the selected patterns is calculated out (step S4) at the pattern number calculating device 4, the selected patterns being arranged in alignment vertically and laterally at the cloth 30 of a size XY. The vertical and lateral magnification rates of the selected unit stippling patterns 20 are calculated out respectively (step S5) so that the whole of the patterns may be in accord with the size of cloth 30, the calculation being made on the basis of the calculated number of patterns and the size of the cloth 30.

In case the calculated magnification rates exceed the predetermined limit magnification rates beyond which the pattern may be deformed (step S6), the fact is indicated at the display (step S12) and the routine returns to the step S1 and another unit stippling pattern of different size is selected (step S1) and the subsequent same operation is repeated.

In case the selected enlarging/reducing magnification rates are not in excess of the predetermined values, enlarging and reducing the stitch data of the stippling pattern 20 is enlarged and reduced at the stitch modifying device 6 (step S7), the calculation being made on the basis of the calculated magnification rates (step S7). Subsequently indicating at the display 8 the stitching information is indicated at the display 8 (step S8), the stitching information including the number of patterns to be arranged in alignment vertically and laterally and the vertical and lateral magnification rates of pattern. In case the printing instruction is given (step S9), the stitch information is given to the printer (step S13), the stitch information including drafting information and the template of unit stippling pattern.

When the instruction is given for starting the stitching operation (step S10), the CPU 100 controls the operation of the machine motor control device 70 and the operation of the X, Y motor control device 72 so that the enlarged and reduced stippling patterns 20 may be stitched by the number in vertical and lateral directions as calculated at the pattern number calculating device 4 (step S11).

Having thus set forth the nature of the invention, what is claimed herein is as follows:

1. A sewing machine for stitching a stippling pattern that is to be depicted in a square embroidery stitching area comprising;

a memory for storing therein stitch data for stitching a stippling pattern, a stitching means for stitching the stippling pattern, a control means for controlling the operation of the stitching means, thereby to stitch the stippling pattern in accordance with the stitch data stored in the memory, the stitch data stored in the memory for stitching the stippling pattern being provided to form convex portions as are depicted substantially in contact with a plurality of points of first group respectively, the points of first group being provided on one of the opposite sides of the square embroidery stitching area, and the stitch data being provided further to form concave portions as are depicted with a predetermined space provided away from a plurality of points of second group respectively, the points of second group being provided on said one of the opposite sides of the square embroidery stitching area, said stitch data being provided to form concave portions as are depicted with a predetermined space provided away from a plurality of points of first group respectively, the points of first group being provided on the other of the opposite sides of the square embroidery stitching area, and said stitch data being provided further to form convex portions as are depicted as arranged substantially in contact with a plurality of points of second group respectively, the points of second group being provided on said other of the opposite sides of the square embroidery stitching area.

2. The sewing machine for stitching a stippling pattern as defined in claim 1, wherein the control means controls the stitching means to stitch the stippling pattern a plurality of times with said one and said other of the opposite sides of the square embroidery stitching area being stitched as arranged in contact with each other.

3. The sewing machine for stitching a stippling pattern as defined in claim 1, further comprising;

an embroidery size input means for inputting a size of area of an object where an embroidery pattern is to be stitched, a pattern number calculating means for calculating out the number that is an integer of stippling patterns that are to be arranged in alignment vertically and laterally in accordance with the size of the object where the embroidery pattern is to be stitched, the calculation being made on the basis of the size of the object where the embroidery pattern is to be stitched and the vertical and lateral lengths of the stippling pattern of the stitch data stored in the pattern memory, a magnification calculating means for calculating out the enlarging/reducing rates of vertical and lateral lengths of the stippling pattern independently so that the stippling pattern may be adapted to the object where the pattern is stitched, the calculation being made on the basis of the number of stippling patterns calculated out at the pattern number calculating means so as to be arranged in alignment vertically and laterally and the size of the object where the pattern is stitched, a stitch modifying means for enlarging/reducing the stitch data of the stippling pattern vertically and laterally in accordance with the enlarging/reducing rates calculated out at the magnification calculating means.

4. The sewing machine for stitching a stippling pattern as defined in claim 3, further comprising;

an enlarging/reducing rate deciding means for deciding if the enlarging/reducing rates calculated out at the magnification calculating means exceed predetermined values, an indicating means for indicating the decision made at the enlarging/reducing rate deciding means.

5. The sewing machine for stitching a stippling pattern as defined in claim 1, wherein the pattern memory stores therein the stitch data for a plurality of stippling patterns having the vertical and lateral lengths, one of which is different from the other.

6. Stitch data for stitching a stippling pattern that is to be depicted in a square embroidery stitching area, the stitch data including;

stitch data for stitching convex portions that are formed as arranged substantially in contact with a plurality of points of first group respectively that are provided on one of the opposite sides of the square embroidery stitching area, stitch data for stitching concave portions that are formed as arranged with a predetermined space provided away from a plurality of points of second group respectively that are provided on said one of the opposite sides of the square embroidery stitching area, stitch data for stitching concave portions that are formed as arranged with a predetermined space provided away from a plurality of points of first group respectively that are provided on the other of the opposite sides of the square embroidery stitching area, stitch data for stitching convex portions that are formed as arranged substantially in contact with a plurality of points of second group respectively that are provided on said other of the opposite sides of the square embroidery stitching area.

7. The stippling pattern as defined in claim 6, wherein the stippling pattern is stitched a plurality of times with said one and said other of the opposite sides of the square embroidery stitching area being arranged in contact with each other.

8. A sewing machine for stitching a stippling pattern that is to be depicted in a square embroidery stitching area, said sewing machine having a control means provided therewith for controlling a stitching mechanism to stitch the stippling pattern;

said control means being provided to control the stitching mechanism to stitch the stippling pattern having convex portions that are formed as arranged substantially in contact with a plurality of points of first group respectively that are provided on one of the opposite sides of the square embroidery stitching area, said control means being provided to control the stitching mechanism to stitch the stippling pattern having concave portions that are formed as arranged with a predetermined space provided away from a plurality of points of second group respectively that are provided on said one of the opposite sides of the square embroidery stitching area, said control means being provided to control the stitching mechanism to stitch the stippling pattern having concave portions that are formed as arranged with a predetermined space provided away from a plurality of points of first group respectively that are provided on said other of the opposite sides of the square embroidery stitching area, said control means being provided to control the stitching mechanism to stitch the stippling pattern having convex portions that are formed as arranged substantially in contact with a plurality of points of second group respectively that are provided on said other of the opposite sides of the square embroidery stitching area.

9. The sewing machine for stitching a stippling pattern as defined in claim 8, wherein the control means is provided to control the stitching mechanism to stitch the stippling pattern a plurality of times so that the one and the other of the opposite sides of the embroidery stitching area may be arranged in contact with each other.

* * * * *